US006087784A

United States Patent [19]

Quinn et al.

[11] Patent Number: 6,087,784

[45] Date of Patent: Jul. 11, 2000

[54] GLOW DISCHARGE LAMP

[75] Inventors: Robert F. Quinn, West Elmira; Jose Mario Quintal, Campbell, both of N.Y.

[73] Assignee: Corning Incorporated, Corning, N.Y.

[21] Appl. No.: 09/338,133

[22] Filed: Jun. 22, 1999

Related U.S. Application Data

[60] Provisional application No. 60/109,245, Nov. 19, 1998.

[51] Int. Cl.[7] ..... H05B 41/16

[52] U.S. Cl. ..... 315/246; 315/58; 315/363; 65/66; 313/493

[58] Field of Search ..... 65/66, 122; 313/493, 313/634, 636, 567, 619, 558; 315/246, 58

[56] References Cited

U.S. PATENT DOCUMENTS

| | | | |
|---|---|---|---|
| 4,393,334 | 7/1983 | Glaser | 315/167 |
| 5,186,668 | 2/1993 | Michael et al. | 445/9 |
| 5,512,799 | 4/1996 | Waymouth | 313/567 |
| 5,811,933 | 9/1998 | Van Den Nieuwenhuizen et al. | 313/570 |
| 5,858,046 | 1/1999 | Allen et al. | 65/66 |
| 5,942,840 | 8/1999 | Steere et al. | 315/25 |
| 5,990,599 | 11/1999 | Jackson et al. | 313/25 |

OTHER PUBLICATIONS

Co–pending International Application No. PCT/US98/23722, filed Nov. 9, 1998, claiming priority to U. S. Provisional Application No. 60/086,042, filed Nov. 18, 1997, entitled "External Electrode Driven Discharge Lamp" by Jackson P. Trentelman.

C.G. Morgan; *Electrical Breakdown of Glasses*; J.M. Meek and J.D. Craggs, eds., Wiley–Interscience, N.Y. 1978 (University Microfilms, Ann Arbor, MI., 1988, p. 655.

Illuminating Engineering Society of North America, *Lighting Handbook, Reference and Application*; Mark S. Rea, editor, 8th ed., New York, NY, 1993, p. 197.

J.M. Meek and J.D. Craggs; *Electrical Breakdown of Gases*; Oxford Press, London, 1953, pp. 348–359.

J.M. Meek and J.D. Craggs; *Electrical Breakdown of Gases*; Oxford Press, London, 1953, pp. 355–359.

J.M. Meek and J.D. Craggs; *Electrical Breakdown of Gases*; Oxford Press, London, 1953, p. 349.

J.M. Meek and J.D. Craggs; *Electrical Breakdown of Gases*; Oxford Press, London, 1953, pp. 359–373.

CRC, *Handbook if Chemistry and Physics*; David R. Lide, editor–in–Chief; 79th Edition (1998–1999); p. 10–183.

CRC, *Handbook if Chemistry and Physics*; David R. Lide, editor–in–Chief; 79th Edition (1998–1999); p. 10–182.

*Primary Examiner*—Don Wong
*Assistant Examiner*—Tuyet T. Vo
*Attorney, Agent, or Firm*—Anca C. Gheorghiu

[57] ABSTRACT

The present invention relates to a glass envelope for an illuminating device, the glass envelope comprising a gas channel, a pair of electrodes in communication with the gas channel and a glow-discharge lamp as a source of free electrons coupled to the glass envelope to assist the starting of the illuminating device in dark conditions, for example at night. Preferably, the glass envelope has a front and back surface laminated and integrated together to form a unitary body essentially free of any sealing materials.

7 Claims, 2 Drawing Sheets

GLOW DISCHARGE LAMP

BACKGROUND OF THE INVENTION

This application claims the benefit of U.S. Provisional Application, Ser. No. 60/109,245, filed Nov. 19, 1998 entitled DARK START ASSIST FOR COLD CATHODE DISCHARGE LAMPS by Robert F. Quinn and Jose M. Quintal.

1. Technical Field.

The present invention relates to an illuminating device, and in particular to a glow discharge lamp which ignites at low voltages in dark conditions, for example at night, with no time lapse.

2. Description of Related Art.

It is known in the art that in order to ignite or start an illuminating device such as a cold-cathode discharge lamp, i.e., to produce an electrical discharge in the gas of the lamp, a free electron must be present and there must be sufficient electrical bias to initiate the avalanche effect to break down or ignition when voltage is applied to the lamp.[1]

A cold cathode discharge lamp is a lamp in which the electrodes generally consist of a metal shell coated with an emissive coating, i.e., internal electrodes and operate to produce a glow discharge.[2] High voltages are required to create electron flow.[3] A hot cathode discharge lamp is a lamp in which an electrode is constructed of a coiled-tungsten wire coated with an emissive coating which heats up during lamp operation, continuously thermally emitting large quantities of electrons at lower voltages than required for cold-cathode operation.[4] An arc discharge is produced in a hot-cathode lamp.[5]

Therefore, unlike hot-cathode or arc-discharge lamps which have a large pool of free electrons, the absence of thermoionic emissions in cold-cathode or glow-discharge lamps leads to a decrease in the availability of free electrons.

Lack of free electrons becomes a problem, especially in dark conditions, such as at night. It is commonly found that in total darkness, cold discharge lamps will not ignite at the same break down voltages as during daylight because at night free electrons are insufficient. Nonetheless, if a high enough break down voltage is applied, a free electron will eventually liberate and ignite the discharge or plasma. This condition, however, is undesirable not only because erratic starting times and long delay times, i.e., time lapses, are created, but also because cost and complexity is added to ballast design as a result of the large difference between the breakdown voltage and the running voltage, i.e., the voltage required to maintain the discharge.

The introduction of a lamp-starting aide in the form of a free-electron source to minimize the starting voltage in a glow discharge lamp is known in the industry.[6] A suitable free-electron source would be radioactivity materials, such as Nickel 63 or Krypton 85 which are added to the gas and continuously emit free electrons required to initiate the avalanche effect.[7] Radioactive materials, however, are potentially hazardous and not very marketable to the consumer. Light sources are easier to provide so long as blue, violet or ultraviolet photons are emitted.[8] Examples of suitable light sources include spark discharges, corona discharges, light emitting diodes (LED's), electro luminescent panels, and tungsten filament flashbulbs.[9] Spark discharges are disadvantageous because of the production of undesirable by-products and lamp-life concerns. A disadvantage of corona discharges is that high voltages are required. LED's and electro luminescent panels have a high cost association which ultimately passes to the end consumer, and tungsten filament flashbulbs have life problems.

Therefore, there exits the need for a simple, yet cost effective, high performance, and long life solution to the dark-start problem, herein above described, for cold-cathode discharge lamps.

We have discovered that a commonly available miniature glow discharge lamp, i.e., no larger than about 12 mm in length, when coupled to our glass envelopes to be used as illuminating devices not only reduces the starting voltage and eliminates time lapse in dark conditions, but also deletes many of the disadvantages herein above described, while at the same time being cost-effective and long lasting.

SUMMARY OF THE INVENTION

Briefly, the present invention provides for a glass envelope to be used as an illuminating device, the glass envelope comprising a gas channel, a pair of electrodes in communication with the gas channel and a glow-discharge lamp as a source of free electrons coupled to the glass envelope to assist the starting of the illuminating device in dark conditions, for example at night. Preferably, the glass envelope has a front and back surface laminated and integrated together to form a unitary body essentially free of any sealing materials.

The illuminating device is preferably a neon lamp and has a starting voltage less than three times the running voltage, below 2 $Kv_p$.

DETAILED DESCRIPTION OF THE PREFERRED EMBODIMENTS

Figure 1:
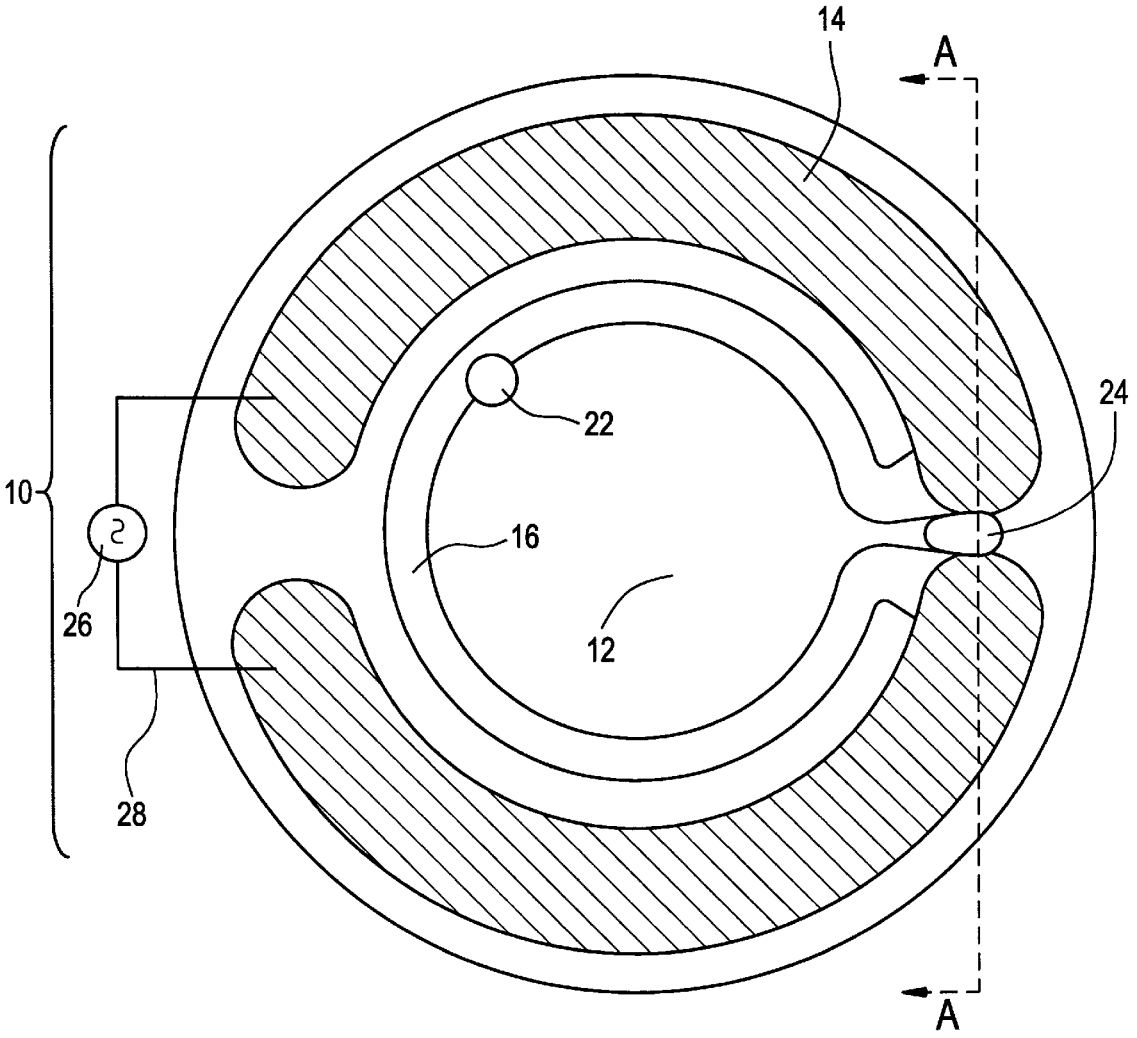
FIG. 1 is a top view of an embodiment of the glow discharge lamp of the present invention.
Figure 1A:
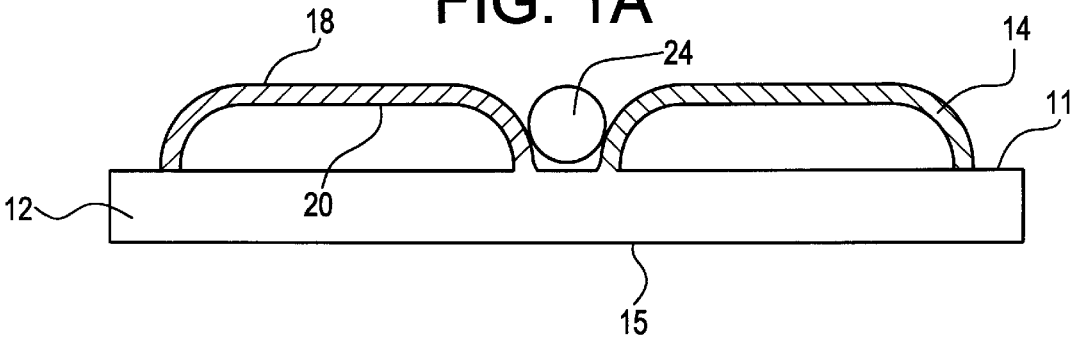
FIG. 1A is a cross-section on line A—A in FIG. 1.

FIGS. 1 and 1A illustrate a cold-cathode discharge lamp in accordance with the present invention. Shown is illuminating device 10 which characterizable as a cold-cathode or a glow-discharge lamp. Illuminating device 10 comprises glass envelope 12. Glass envelope 12 comprises external electrodes 14, of the type described in co-pending International Application No. PCT/US98/23722, filed Nov. 9, 1998, claiming priority to U.S. Provisional Application Ser. No. 60/086,042, filed Nov. 18, 1997, entitled "External Electrode Driven Discharge Lamp" by Jackson P. Trentelman, co-assigned to the instant assignee and herein incorporated by reference in its entirety, and gas-channel 16. External electrodes 14 are formed by applying a coating 18 of an emissive material, preferably aluminum-copper, to bulbous glass regions 20 molded in the glass envelope during the envelope forming process.

Alternatively, conventional internal electrodes may also be employed, whereby the internal electrodes would be attached to sites which are in communication with the gas channel via glass-to-glass seals, i.e., vacuum sealed to form discharge paths and electrical communication with the interior of the gas-channel.

Glass envelope 12 may be formed according to the methods described in U.S. Pat. No. 5,858,046 entitled "Method of making an internally channeled glass article"

(Allen et. al.) co-assigned to the instant assignee, and herein incorporated by reference in its entirety. The method disclosed comprises successively delivering two sheets from a source of glass. A first sheet is delivered to a mold assembly having the desired channel forming pattern and a peripheral surface which the first glass sheet overlies. The first glass sheet is caused to conform to the mold by the force of gravity, drawing a vacuum, or by a combination of these forces. A second sheet is then delivered over the conformed, bottom sheet at a viscosity such that it hermetically seals to the raised portions of the bottom sheet, but does not sag into the molded channel portions. The resulting glass envelope, i.e., glass envelope 12, has a front surface 13 and a back surface 15 laminated and integrated together to form a unitary envelope body essentially free of any sealing materials.

Gas channel 16 which is in communication with external electrodes 14 is evacuated and backfilled with an ionizable gas through tubulation port 22, which in turn is in communication with the external environment. The preferred ionizable gas is neon, although any of the noble gases or mixtures thereof may be used, including but not limited to xenon, krypton, argon, helium and mixtures thereof with mercury.

Shown at 24 is assist discharge lamp; more specifically, a miniature glow discharge lamp no larger than 12 mm which emits light in the blue region of the spectrum, such as is manufactured by GBC, Inc of Ocean, N.J. model no. NE 61230 B; the assist discharge lamp is thought to contain xenon. It is contemplated, however, that the assist discharge lamp may contain any noble gas or mixture thereof.

Assist discharge lamp 24 is capacitively coupled to external electrodes 14 such that no leads are required. No leads are required for capacitive coupling because energy couples through the glass envelope. Assist discharge lamp 24 acts as a free source of electrons to assist in the starting of illuminating device 10 during dark conditions.

As it is illustrated in FIG. 1, assist discharge lamp 24 is attached to glass envelope 12 between external electrodes 14 to achieve capacitive coupling. A fixture may be pressed in the periphery of the glass envelope during the forming process to properly attach assist discharge lamp 24 to glass envelope 12.

It must be noted that where internal electrodes are employed, the assist discharge lamp requires hook-up to one of the electrode sites, and cannot be capacitively coupled without at least one lead being connected.

A ballast or a high voltage source 26 is connected to external electrodes 14 via leads 28. Suitable ballasts and leads are well known in the art.

EXAMPLE

A glass envelope including a gas-channel, external electrodes in communication with the gas-channel and an assist discharge lamp capacitively coupled to the external electrodes, of the type as illustrated in FIG. 1, has been successfully manufactured as an illuminating device.

The glass envelope which has a front surface and a back surface laminated and integrated together to form a unitary envelope body essentially free of any sealing materials is made according to the method described herein above and has dimensions of 100 mm in diameter.

The glass composition employed consists essentially, in terms of weight percent on the oxide basis, of: 82 wt % $SiO_2$, 2 wt. % $Al_2O_3$, 12 wt. % $B_2O_3$, and 4 wt. % $Na_2O$.

Following formation of the glass envelope, the glass channel is evacuated and backfilled to a pressure of preferably 5–10 torr with neon using conventional lamp processing techniques.

Thereafter, a 115 volt, glow-discharge lamp with blue phosphor, i.e., the assist discharge lamp, as manufactured by GBC, Inc. of Ocean, N.J., is capacitively coupled across the external electrodes, as shown in FIG. 1, to a fixture pressed in the periphery of the glass envelope between the external electrodes. The exact dimensions of the assist discharge lamp are 6 mm×12 mm.

To illuminate the glass envelope, a ballast or power source must be attached thereto, such as a variable frequency plasma generated which may be connected via art-known leads.

Figure 2:
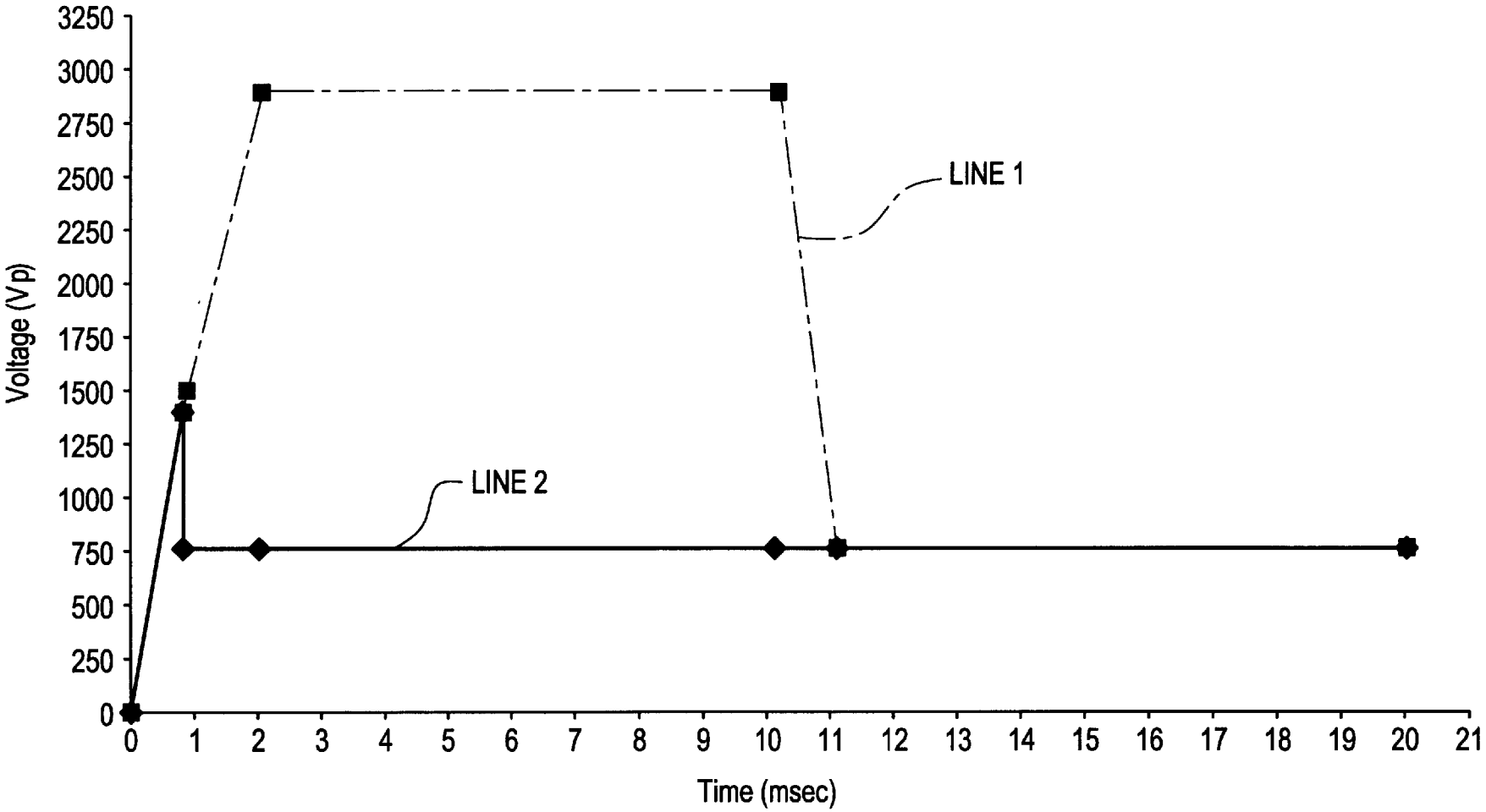
FIG. 2 is a graph illustrating a comparison between the ignition voltage and time for a glow discharge lamp of the present invention with and without an assist discharge lamp.

In FIG. 2 therein illustrated is a graph which compares the ignition voltage (as measured in peak voltage ($v_p$)) and time of the illuminating device herein above described, with and without the coupling of an assist discharge lamp. Line 1 illustrates peak voltage versus time for an illuminating device without assist discharge lamp. Line 2 illustrates peak voltage versus time for the same illuminating device with assist discharge lamp. It should be noted that in the experimental set-up the maximum lamp voltage was limited to 2.8 $Kv_p$ because that was thought to be the design voltage of the ballast at the time.

Referring now to Line 1, the voltage applied rises with no ignition until the maximum set lamp voltage is achieved at 2.8 $Kv_p$. Even at this high voltage value there is no ignition until after a period of 8 seconds, because even though there is enough electrical bias to initiate the avalanche effect to break down, a free electron is not present. After a time lapse of 8 seconds, however, a free electron is liberated and now the two conditions of sufficient electrical bias and the availability of a free electron are present, such that ignition of the lamp is achieved at about 10.5 seconds, as is apparent from the sharp drop in voltage to about 750 $v_p$. The drop in voltage is a result in the drop in lamp resistance as discharge is achieved. Once ignition is achieved a running voltage of 750 $v_p$ is maintained.

The addition of an assist discharge lamp results in instant ignition, i.e., no time lapse, at a much lower starting voltage, as illustrated by Line 2. As the voltage applied rises above 500 $v_p$ the assist discharge lamp starts to glow, producing light in the blue region of the spectrum due to the blue phosphor it contains. The assist discharge lamp glows at this low voltage because it has a low starting voltage; more specifically the starting voltage of the assist discharge lamp is about 300 $v_p$. Briefly, in a glow-discharge lamp the starting voltage is a function, among other variables, of lamp size and ionization potential of the gas. Therefore, due to the small size of the lamp and the low ionization energy of filling gas, xenon, of about 12 eV the starting voltage of the assist discharge lamp is small and glow appears above 500 $v_p$, which provides free electrons.[10] However, even though free electrons are available, there is not sufficient electrical bias to initiate the avalanche effect to break down at 500 $v_p$. It was found that electrical bias in our lamps occurs at about 1.3 $Kv_p$. One of the reasons why the starting voltage in our lamps is much higher than the starting voltage in the assist discharge lamp is because the glass envelope has a larger size and is filled with neon, which has an ionization potential of about 22 eV.[11]

As soon as the voltage reaches 1.3 $Kv_p$ ignition occurs in the illuminating device of the present invention with no time lag, because free electrons are available from the assist discharge lamp.

After the lamp is ignited the lamp resistance drops causing the voltage to drop to a running voltage of 750 $v_p$, as described herein above. Once the voltage drops the light level of the assist lamp is lowered to a non-noticeable level. Alternatively, the assist lamp can be turned off completely once ignition occurs in the discharge lamp by manipulating lamp spacing relative to the electrodes.

Therefore, with the assist discharge lamp the glow-discharge lamp is ignited at a lower voltage, 1.3 $Kv_p$ versus 2.8 $Kv_p$ (without the assist discharge lamp). Furthermore, with an assist discharge lamp as soon as there is sufficient electrical bias, ignition is simultaneous and there is no time lapse because free electrons are readily available. Whereas, in the absence of an assist lamp there is a time lapse, after electrical bias is achieved, until a free electron is liberated and is in the correct location which is often a very random process.

REFERENCES

1. C. G. Morgan; *Electrical Breakdown of Glasses;* J. M. Meek and J. D. Craggs, eds., Wiley-Interscience, N.Y. 1978 (University Microfilms, Ann Arbor Mich., 1988, page 655.
2. Illuminating Engineering Society of North America; *Lighting Handbook Reference and Application;* Mark S. Rea, editor-in-Chief, 8th Edition, New York, N.Y., page 197.
3. Ibid.
4. Ibid.
5. Ibid.
6. J. M. Meek and J. D. Craggs; *Electrical Breakdown of Glasses;* Oxford Press, London, 1953, pages 348–373.
7. Ibid., pages 355–359.
8. Ibid., page 349.
9. Ibid., page 359–373.
10. CRC, *Handbook of Chemistry and Physics;* David R. Lide, editor-in-Chief; 79th Edition (1998–1999); page 10–183.
11. Ibid.; page 10–182.

Although the now preferred embodiments of the invention have been set forth, it will be apparent to those skilled in the art that various changes and modifications may be made thereto without departing from the spirit and scope of the invention as set forth in the following claims.

What is claimed is:

1. A glass envelope for a cold-cathode discharge lamp, said glass envelope comprising a gas channel, a pair of external electrodes in communication with said gas channel and an ignition assist glow-discharge lamp as a source of free electrons capacitively coupled between said external electrodes to assist the starting of said illuminating device in dark conditions.

2. The glass envelope of claim 1 wherein said glass envelope has a front surface and a back surface laminated and integrated together to form a unitary flat body essentially free of any sealing materials.

3. The glass envelope of claim 1 wherein said ignition assist glow-discharge lamp glows blue light at voltages greater than 300 $v_p$.

4. The illuminating device of claim 1 wherein said glass envelope is made of borosilicate glass having the a composition consisting essentially, in terms of weight percent on the oxide basis, of 82 wt. % $SiO_2$, 2 wt. % $Al_2O_3$, 12 wt. % $B_2O_3$, and 4 wt. % $Na_2O$.

5. A low pressure cold-cathode discharge lamp comprising:

a glass envelope having a front surface and a back surface laminated and integrated together to form a unitary flat body essentially free of any sealing materials and comprising a gas channel and a pair of electrodes in connection with said gas channel;

an ignition assist glow-discharge lamp emitting blue light and acting as a source of free electrons for said low pressure cold-cathode discharge lamp in dark conditions, said ignition assist glow-discharge lamp capacitively coupled to said electrodes on said front surface of said glass envelope;

whereby said low-pressure cold-cathode discharge lamp is ignited at a starting voltage of less than 2 $Kv_p$.

6. The low pressure cold-cathode discharge lamp of claim 1 wherein said electrodes are external to said glass envelope.

7. The low pressure cold-cathode discharge lamp of claim 6 wherein said electrodes external to said glass envelope comprise a coating of an emissive material applied to a pair of bulbous glass regions molded in said glass envelope.

* * * * *